US008449626B2

(12) United States Patent
De Buzzaccarini et al.

(10) Patent No.: US 8,449,626 B2
(45) Date of Patent: May 28, 2013

(54) CLEANING METHOD

(75) Inventors: Francesco De Buzzaccarini, Breendonk (BE); Rapheal Angeline Alfons Ceulemans, Holsbeek (BE); Edward Robert Offshack, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/916,853

(22) Filed: Nov. 1, 2010

(65) Prior Publication Data

US 2011/0107527 A1 May 12, 2011

Related U.S. Application Data

(60) Provisional application No. 61/260,114, filed on Nov. 11, 2009.

(51) Int. Cl.

| | |
|---|---|
| ***C11D 3/395*** | (2006.01) |
| ***C11D 3/40*** | (2006.01) |
| ***C11D 3/42*** | (2006.01) |
| ***C11D 3/50*** | (2006.01) |
| ***C11D 3/60*** | (2006.01) |
| ***C11D 7/60*** | (2006.01) |
| ***C11D 7/54*** | (2006.01) |
| ***C11D 1/00*** | (2006.01) |

(52) U.S. Cl.

USPC ..... 8/137; 510/276; 510/277; 510/302; 510/303; 510/305; 510/320; 510/321; 510/337; 510/349; 510/367; 510/369; 510/405; 510/419; 510/441; 510/535

(58) Field of Classification Search

USPC ..... 8/137, 101, 102, 107, 108.1, 109, 8/111; 510/276, 277, 302, 305, 303, 320, 510/321, 337, 349, 367, 369, 405, 419, 441, 510/535

See application file for complete search history.

(56) References Cited

U.S. PATENT DOCUMENTS

| | | | | |
|---|---|---|---|---|
| 1,777,858 | A * | 10/1930 | Phair | 8/137 |
| 2,202,333 | A * | 5/1940 | Butterworth | 8/109 |
| 3,178,916 | A * | 4/1965 | Belaieff et al. | 68/23.2 |
| 5,686,376 | A * | 11/1997 | Rusche et al. | 502/329 |
| 5,773,408 | A * | 6/1998 | Trinh et al. | 510/520 |
| 5,773,763 | A * | 6/1998 | Stachulla | 174/135 |
| 5,893,191 | A | 4/1999 | Schneider et al. | |
| 6,462,007 | B1 * | 10/2002 | Pieroni et al. | 510/224 |
| 6,534,463 | B1 | 3/2003 | Briatore et al. | |
| 2002/0137653 | A1 | 9/2002 | Gordon | |
| 2007/0214579 | A1 | 9/2007 | Bianchetti et al. | |
| 2008/0178396 | A1 * | 7/2008 | van der Linden et al. | 8/137 |

FOREIGN PATENT DOCUMENTS

WO WO 2010/006861 A1 1/2010

OTHER PUBLICATIONS

Int'l Search Report—11 Pages.

* cited by examiner

*Primary Examiner* — Lorna M Douyon
*Assistant Examiner* — Amina Khan
(74) *Attorney, Agent, or Firm* — Tiffany M. Zerby; Steven W. Miller

(57) ABSTRACT

Described is a method of cleaning a white load in a laundry machine, preferably a professional laundry machine, the method comprises subjecting the load to at least two washing steps and wherein the method comprises the steps of delivering bleach and subsequently a whitening additive.

11 Claims, No Drawings

CLEANING METHOD

CROSS REFERENCE TO RELATED APPLICATION

This application claims the benefit of U.S. Provisional Application Ser. No. 61/260,114, filed Nov. 11, 2009.

TECHNICAL FIELD

The present invention is in the field of laundry. In particular, it relates to a method of industrial or institutional laundry (i.e., professional laundry) for a white load using bleach and a whitening additive. The method produces outstanding results in terms of stain removal, whiteness and odour improvement.

BACKGROUND OF THE INVENTION

Bleach, in particular halogen bleach, is often used to remove bleachable stains from white fabrics. White fabrics seem to loose their whiteness with time due to use, exposure to light and sometimes laundry processes. Bleach, in particular halogen bleach, can contribute to the deterioration of the appearance of white fabrics. Bleach can also leave on washed items an odour that users can sometimes find unpleasant.

U.S. Pat. No. 5,893,191 recognises the problem of yellowing of synthetic fibres caused by hypochlorite bleach. The solution proposed by '191 is the addition of silicate to the hypochlorite composition. U.S. Pat. No. 6,534,463 proposes the use of borate, boric acid and metal oxide in a hypochlorite containing composition to avoid yellowing of fabrics.

There is still a need for laundry methods and laundry additives which provide good soil removal and at the same time provide a good whitening profile and leave the washed items free of bleach odour. There is also a need for laundry methods with improved environmental profiles.

SUMMARY OF THE INVENTION

According to the first aspect of the invention, there is provided a method of cleaning a white load in a laundry machine, preferably a professional laundry machine. By a "white load" is herein meant a load containing, by weight of the load, at least 70%, preferably at least 80%, more preferably at least 90% and especially preferred a load containing 100% of white items.

The method comprises subjecting the load to at least two different washing steps (first, and second washing steps), preferably at least three, more preferably at least four or even five washing steps. By "washing step" herein is meant a wash cycle in which a laundry active is delivered (for example a detergent, a bleach, a whitening additive, etc), that can be a cycle using fresh water in the cases of batch operating laundry machine or a cycle later in time in the case of a continuous laundry machine. The first step could be equated with the main-wash and the second step with a rinse in the case of a batch laundry machine.

The method comprises the steps of delivering bleach and subsequently a whitening additive. By "subsequently" is herein meant that the whitening additive is delivered at least 1 minute, preferably at least 5 minutes, more preferably at least 10 minutes and specially at least 15 minutes after the bleach. Preferably the whitening additive and the bleach are delivered in different washing steps.

Although any bleach can be used in the method of the invention, the use of halogen bleach, peroxyacid bleach and mixtures thereof is preferred herein. If halogen and peroxyacid bleach are both used in the same laundry process, they are preferably delivered separately from one another. Halogen bleach is preferred for use herein. Halogen bleach, preferably hypochlorite bleach and more preferably sodium hypochlorite is very effective for the removal of coloured stains and in addition provides sanitization of the washed items, that is particularly relevant in professional laundry.

The method provides good stain removal, good whiteness maintenance and leaves the load free of bleach odour. The method is suitable for loads of natural materials, synthetic materials and mixtures thereof. It has been found that synthetic materials, such as lycra and nylon are prone to yellowing, in particular when the materials are exposed to peroxyacid bleach, in particular to phtalimidoperoxy hexanoic acid (PAP). The method of the invention overcomes the yellowing issue, even when synthetic materials are exposed to PAP. PAP is the preferred peroxyacid bleach for use in the method of the invention.

In a preferred embodiment, the method of the invention comprises the step of delivering a detergent, i.e., a laundry detergent comprising cleaning actives such as surfactants, builders, enzymes, etc. The detergent may comprise bleach or being free of bleach, preferably the detergent is free of bleach. The detergent may comprise the whitening additive or be free of it. Preferably the detergent is free of whitening additive. It is also preferred that the bleach is provided not as part of the detergent but as part of a bleach additive. It is preferred to have the whitening additive as a separate product from the detergent and from the bleach additive.

The method of the invention allows for the delivery of different products, including, detergent, bleach, whitening additive, fabric enhancer, etc in different or the same washing steps of a professional laundry process. A preferred dosing regime involves the delivery of the bleach in the first washing step and the detergent and whitening additive in the second washing step. This dosing regime provides whitening benefits. Preferably the whitening additive is delivered before the detergent. Preferably the detergent is delivered at least 1 minute, more preferably at least 5 minutes and especially at least 10 minutes after the whitening additive. Preferably, the whitening additive comprises a bleach scavenger. This helps to mitigate the negative bleach/enzyme interaction in the case of detergents comprising enzymes.

Another preferred dosing regime involves the delivery of the detergent in the first washing step, the bleach in the second washing step and the whitening additive in a third or subsequent washing step. This regime is also advantageous in the case of detergents comprising enzymes because the enzymes act before the bleach thereby avoiding the negative interaction between bleach and enzymes. The benefit is greater in the case of hypochlorite bleach. This regime has been found beneficial from a stain removal standpoint.

Another preferred dosing regime involves the delivery of bleach in the first washing step, detergent in the second washing step and whitening additive in a third or subsequent washing step, preferably in the last washing step.

Still another preferred dosing regime involves the delivery of detergent in the first washing step, bleach at the beginning of the second washing step; the whitening additive, preferably containing a bleach scavenger, is delivered in the second washing step preferably at least 1 minute, more preferably at least 5 minutes and especially at least 10 minutes after the bleach. This regime provides environmental benefits due to the reduction of bleach active species delivered into the environment. It also allows for a reduced number of washing steps, thereby saving time and energy.

According to another aspect of the invention, there is provided a whitening additive. The whitening additive provides excellent white care even when the laundry process involves the use of bleach. The whitening additive prevents the yellowing of fabrics that can be caused by bleach and also leaves the fabrics free of bleach odour. The whitening additive preferably comprises a bleach scavenger. In a preferred embodiment the bleach scavenger is thiosulfate, more preferably sodium thiosulfate. More whitening benefits are obtained when the whitening additive comprises a hueing dye or a brightener and even more when the additive comprises a combination thereof. The preferred hueing dye for use here is compound 2 depicted herein below. The preferred brightener for use herein is Tinopal CBS.

The delivery of a whitening additive, comprising a bleach scavenger, after the bleach, greatly reduces the amount of bleach discharged into the environment. This is particularly advantageous in the case of halogen bleach, especially in the case of hypochlorite bleach that might not have a very good environmental profile. The amount of hypochlorite discharged to the environment is considerably reduced.

In preferred embodiments the method of the invention involves the delivery of from about 50 to about 1500 ppm, more preferably from about 80 to about 500 ppm and especially from about 100 to about 400 ppm of bleach to the wash liquor and from about 10 to about 500 ppm, more preferably from about 30 to about 100 ppm and especially from about 50 to about 150 ppm of bleach scavenger to the wash liquor. By "wash liquor" is herein meant any liquor of the laundry process, including the liquors of the first, second and subsequently washing steps.

In another preferred embodiment the method of the invention includes the step of delivery a fabric enhancer in a third or subsequently step. Preferably the fabric enhancer comprises a perfume and more preferably at least part of the perfume is provided as part of a slow perfume delivery system, in particular as perfume microcapsules.

According to the last aspect of the invention, there is provided the use of a bleach scavenger to provide whitening and bleach malodour removal benefits to a load of white items washed in a professional laundry machine in the presence of bleach, in particular in the presence of halogen bleach.

DETAILED DESCRIPTION OF THE INVENTION

The present invention envisages a method of cleaning a white load in a laundry machine, preferably in a professional laundry machine. The method involves contacting the load with bleach and subsequently with a whitening additive. The method provides improved cleaning, better white care and odour of the washed items. The invention also envisages a whitening additive comprising a bleach scavenger and preferably a hueing dye or a brightener and even more preferably a mixture thereof. Lastly, the invention also envisages the use of a bleach scavenger to improve the whitening appearance and odour profile of a white load washed in presence of bleach. It also allows for a reduced number of washing steps, thereby saving time and energy.

Professional laundry includes institutional and industrial (sometimes also referred to as commercial) laundry. Institutional laundry refers to textile washing operations usually run in business sites, normally referred to as On-Premise or In-House Laundry Operations. Typical businesses can be for instance hotels, restaurants, care homes, hospitals, spas, health or sport clubs, schools, and similar institutions. Industrial laundry refers to textile washing operations carried out in dedicated places typically for the above businesses.

By "professional laundry machine" is herein meant a laundry machine with a capacity which is usually higher than 5 kg, preferably higher than 10 kg and more preferably higher than 20 kg of dry laundry.

There are two main types of professional laundry machines: front load which operate in a batch mode or tunnel washing machines that operate in continuous mode. The professional laundry machines for use herein, in the case of front load have a drum volume of at least about 0.05 $m^3$, preferably at least 0.1 $m^3$, more preferably at least 0.3 $m^3$ and especially at least 0.5 $m^3$. The professional laundry machines for use herein, in the case of front load have a drum diameter of at least about 0.4 m, preferably at least 0.8 m and more preferably at least 1 m. In the case of tunnel washing machines, typically found in industrial or commercial laundries, the tunnel has a diameter of at least about 1.5 m, preferably at least 3 m and more preferably at least 5 m.

The essential actives of the invention are bleach and a whitening additive. Both of them are preferably delivered in the form of additives rather than as part of a detergent, although they can be part of the detergent. Optionally, the method involves the delivery of a detergent and a fabric enhancer.

Delivery Regimes

The method of the present invention requires the delivery of bleach and subsequently a whitening additive. The method also envisages embodiments in which detergent and optionally a fabric enhancer is/are delivered. The method is flexible regarding when the different products are delivered into the laundry process. Some delivery regimes include the delivery of detergent in the first washing step, bleach in the second washing step and the whitening additive in a third or subsequent step. Usually a professional laundry process includes three different rinse steps, the whitening additive can be delivered into the first, second or third rinse steps. Preferably a fabric enhancer is delivered in the last rinse step (usually in the third rinse step). As indicated before, these kind of dosing regimes in which the detergent is dosed in the first washing step provide improved stain removal. Without being bound by theory it is believed that this is due to the fact that the negative interaction between enzymes and bleach is avoided.

Another preferred dosing regime involves the delivery of detergent in the first washing step and the delivery of bleach and whitening additive in the second washing step. Preferably, the whitening additive is delivered at least 5 minutes, more preferably at least 10 minutes and specially at least 15 minutes after the bleach. This again provides a good stain removal. Another advantage associated to this kind of regimes is that the whitening additive, in particular when it comprises a bleach scavenger, reduces the amount of bleach discharged to the environment, thereby improving the environmental profile of the process. Preferably a fabric enhancer is delivered in the last washing step.

Other dosing regimes provide for the delivery of bleach in the first and detergent in the second washing step. These dosing regimes provide improve whiteness maintenance. The whitening additive could for example be delivered in the second washing step together with the detergent (for example, as part of the detergent) or after the detergent. Alternatively, the whitener additive could be delivered in a third or subsequent washing step, preferably in the last washing step. Another alternative could be the delivery of the detergent and bleach in the second washing step and the whitening additive in a third or subsequent washing step, preferably in the last washing step.

Bleach

The bleach to be delivered in the method of the invention can be delivered as part of a detergent and/or as part of an additive. Preferably, it is delivered in the form of an additive. The additive may be formulated either as solid or liquid, preferably the bleach additive is in liquid form and contains halogen bleach. In the cases in which the bleaching compositions are formulated as liquids, including gel and paste form, the bleaching compositions are preferably but not necessarily formulated as aqueous compositions. Liquid bleaching compositions are preferred herein for convenience of use. Preferred liquid bleaching compositions of the present invention are aqueous and therefore, preferably comprise water in an amount of from 60% to 98%, more preferably of from 70% to 97% and most preferably 80% to 97% by weight of the total composition.

Any bleach known to those skilled in the art may be suitable for use herein. Preferred bleaches include halogen bleaches such as for instance chlorine, bromine, chlorine dioxide, chlorite salts, etc. Preferred halogen bleaches are hypohalite salts. Suitable hypohalite bleaches may be provided by a variety of sources, including bleaches that lead to the formation of positive halide ions and/or hypohalite ions, as well as bleaches that are organic based sources of halides such as chloroisocyanurates. Suitable hypohalite bleaches for use herein include the alkali metal and alkaline earth metal hypochlorites, hypobromites, hypoiodites, chlorinated trisodium phosphate dodecahydrates, potassium and sodium dichloroisocyanurates, potassium and sodium trichlorocyanurates, N-chloroimides, N-chloroamides, N-chloroamines and chlorohydantoins. For the bleaching compositions herein, the preferred hypohalite bleaches among those described above are the alkali metal or alkaline earth metal hypochlorites selected from the group consisting of sodium, potassium, magnesium, lithium and calcium hypochlorites, and mixtures thereof. Sodium hypochlorite is the most preferred hypohalite bleach.

Suitable peroxygen bleaches to be used herein include hydrogen peroxide (or water soluble sources thereof), persulfates (such as monopersulfates), persilicates, peroxyacids, alkyl peroxides and acyl peroxides. A hydrogen peroxide source refers to any compound that produces perhydroxyl ions when said compound is in contact with water, such as for instance percarbonates and perborates. Preferred peroxygen bleaches are organic peroxyacids, such as for instance peroxyacetic acid, peroxyoctanoic acid and diperoxydodecandioic acid. A particularly preferred peroxyacid is phtalimidoperoxy hexanoic acid (PAP).

The bleach is preferably delivery in the form of an additive. Further ingredients of the bleach additive can include chelants, viscosity regulators, buffers, physical or chemical stabilizers, perfume and fabric care agents.

Preferably, the level of bleach in the wash liquor is from about 50 to about 1500 ppm, more preferably from about 80 to about 500 ppm and especially from about 100 to about 400 ppm.

Whitening Additive

The whitening additive for use herein preferably have a neutral pH, i.e. from about 5 to about 9, more preferably from about 6 to about 8 (as measured at 1% wt solution in distilled water at 20° C.). Additives having this pH range have been found to be less aggressive on fabrics than acid or alkaline solutions.

Preferably the whitening additive is in liquid form so it can be easily delivered by means of a displacement pump, for example a peristaltic pump. The additive can be an aqueous structured liquid. The additive comprises bleach scavenger in a level of from about 1% to about 30%, more preferably from about 2% to about 20% and especially from about 3% to about 10% by weight of the whitening additive. If a hueing dye is present in the whitening additive the level is from about 0.0001% to about 0.5%, preferably from about 0.005% to about 0.1% and more preferably from about 0.01% to about 0.03% by weight of the whitening additive. If a brightener is present in the whitening additive the level is from about 0.05% to about 5%, preferably from about 0.1% to about 2 and more preferably from about 0.3% to about 1% by weight of the whitening additive.

Optionally, the whitening additive can also include other components which can deliver whiteness, odor or cleaning benefits (in the same or in subsequent wash cycles) by depositing onto the fabric and modifying its surface. Such compounds can be for instance enzymes such as lipases, cellulases, cutinases, xylogucanases; polymers such as soil release polymers; soil repellant agents. It can also comprise materials delivering fabric enhancing benefits. Such benefits can include, for example, fabric softness, anti-static effects, ease-of-ironing benefits, anti-abrasion benefits, anti-pilling effects, wrinkle removal or improved resistance to wrinkling, fabric substantive perfume or odor benefits, malodor protection benefits, and the like.

Preferably, the additive is free of ingredients acting on soil in the washing cycle, such as bleaches, builders, protease and amylase enzymes.

Bleach Scavenger

Suitable bleach scavengers herein are anions selected from the group consisting of reducing materials like sulfite, bisulfite, thiosulfite, thiosulfate, iodide, nitrite, etc. and antioxidants like carbamate, ascorbate, etc. and mixtures thereof. Outstanding benefits have been obtained with thiosulfate, in particular with sodium thiosulfate.

Other bleach scavengers useful herein include ammonium sulfate, and primary and secondary amines of low volatility such as ethanolamines, preferably monoethanolamine, amino acids and their salts, polyamino acids and their salts, fatty amines, glucosamine and other aminated sugars. Specific examples include tris(hydroxymethyl)aminomethane, monoethanol amine, diethanol amine, triethanolamine, sarcosine, glycine, iminodiacetic acid, lysine, ethylenediamine diacetic acid, 2,2,6,6-tetramethyl piperinol, and 2,2,6,6-tetramethyl piperinone.

Other bleach scavengers include phenol, phenol sulfonate, 2,2-biphenol, tiron, and t-butyl hydroquinone. Preferred are meta-polyphenols such as resorcinol, resorcinol monoacetate, 2,4-dihydroxybenzoic acid, 3,5-dihydroxybenzoic acid, 2,4-dihydroxyacetophenone, BHT and TMBA.

Hueing Dye

The whitening composition can comprise a hueing dye. A hueing dye is defined as a dye which upon washing provides white fabrics with a light off-white tint, modifying whiteness appearance and acceptance (e.g. providing aqua, or blue, or violet, or pink hue). The hueing dye may have a substantially intense color as a raw material and may color a fabric by selectively absorbing certain wavelengths of light.

The hueing dye may be a conjugated system, allowing them to absorb energy in the visible part of the spectra. The most commonly encountered conjugated systems include phthalocyanine, anthraquinone, azo, phenyl groups, referred to as chromophore. Dyes can be chosen from the following categories: reactive dyes, direct dyes, sulphur and azoic dyes, acid dyes, and disperse dyes.

Preferred hueing dyes have the following structure of formula I:

Formula 1

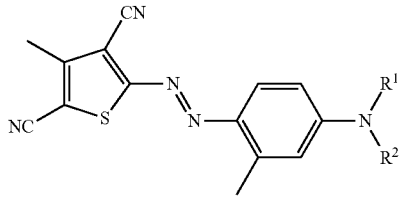

Wherein $R_1$ and $R_2$ can independently be selected from a) $[(CH_2CR'HO)_x(CH_2CR''HO)_yH]$ wherein R' is selected from the group consisting of H, $CH_3$, $CH_2(CH_2CH_2O)_z$ and mixtures thereof; wherein R" is selected from the group consisting of H, $CH_2(CH_2CH_2O)_nH$, and mixtures thereof; wherein $x+y \leqq 5$, wherein $y \geqq 1$; and wherein z=0 to 5;

b) $R_1$=alkyl, aryl or aryl alkyl and $R_2=[(CH_2CR'HO)_x(CH_2CR''HO)_yH]$ wherein R' is selected from the group consisting of H, $CH_3$, $CH_2(CH_2CH_2O)_nH$, and mixtures thereof; wherein R" is selected from the group consisting of H, $CH_2(CH_2CH_2O)_zH$, and mixtures thereof; wherein $x+y \leqq 10$; wherein $y \geqq 1$; and wherein z=0 to 5;

c) $R_1=[CH_2CH(OR_3)\ CH_2OR_4]$ and $R_{24}=[CH_2CH(OR_3)\ CH_2OR_4]$ wherein $R_3$ is selected from the group consisting of H, $CH_2(CH_2CH_2O)_zH$, and mixtures thereof; and wherein z=0 to 10; wherein $R_4$ is selected from the group consisting of $(C_{1-6})$ alkyl, aryl groups, and mixtures thereof;

d) wherein $R_1$ and $R_2$ can independently be selected from the amino addition group of styrene oxide, glycidyl methyl ether, isobutylglycidyl ether, isopropylglycidyl ether, t-butyl glycidyl ether, 2 ethylhexylglycidyl ether, and glycidylhexadecyl ether, followed by addition of from 1 to 10 alkylene oxide units.

More preferred hueing dyes have the structure of formula I wherein each $R^1$ and $R^2$ are independently selected from $[(CH_2CR'HO)_x(CH_2CR''HO)_yH]$, wherein R' is independently selected from the group consisting of H, $CH_3$, $CH_2O(CH_2CH_2O)_zH$, and mixtures thereof, and R" is selected from the group consisting of H, $CH_3$, $CH_2O(CH_2CH_2O)_nH$, and mixtures thereof; wherein $x+y \leqq 5$; wherein $y \geqq 1$; and wherein z=0 to 5.

The compounds of formula I may be synthesized according to the procedure disclosed in U.S. Pat. No. 4,912,203 to Kluger et al. In particular, the hueing dye of formula I may be one of the following compounds 1-5:

Compound 1

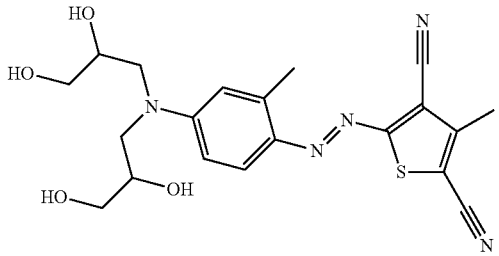

Compound 2

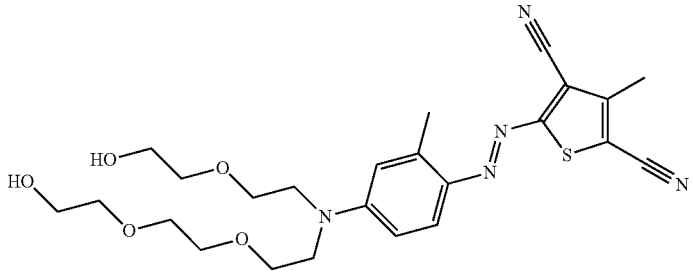

Compound 3

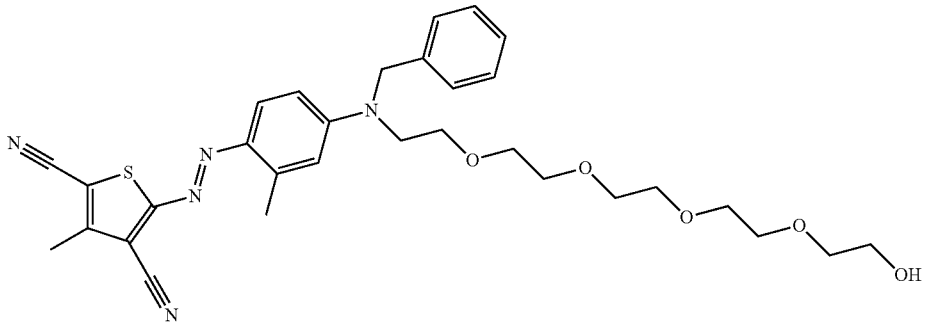

-continued

Compound 4

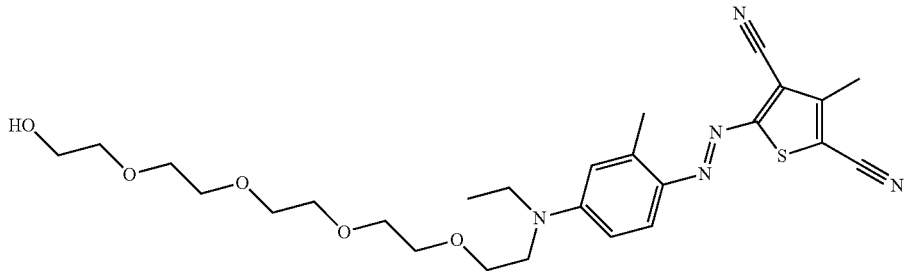

Compound 5

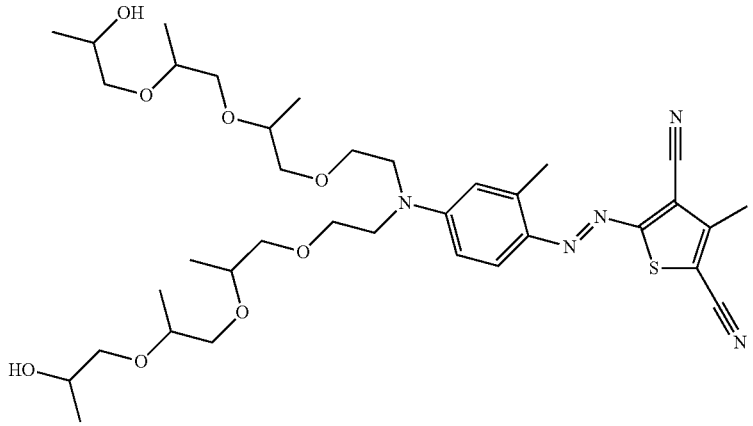

Other similar compounds are described in patent application US 2008/0177089

The hueing dye may be a photobleach. Photobleaches are molecules which absorb the energy from sunlight and transfer it by reacting with another molecule (typically oxygen) to produce bleaching species (singlet oxygen). Photobleaches generally comprise conjugated rings, and therefore usually present a strong visible color. Typical photobleaches comprises phthalocyanines based on zinc, copper, silicon, or aluminium. Also combinations of hueing dyes and photobleaches can be used, as described for instance in patent application WO 2005/014769.

The hueing dye may be a small molecule dye or a polymeric dye. Suitable small molecule dyes include, but are not limited to, small molecule dyes selected from the group consisting of dyes falling into the Colour Index (C.I.) classifications of Direct Blue, Direct Red, Direct Violet, Acid Blue, Acid Red, Acid Violet, Basic Blue, Basic Violet and Basic Red, or mixtures thereof, for example:

(1) Tris-Azo Direct Blue Dyes of the Formula

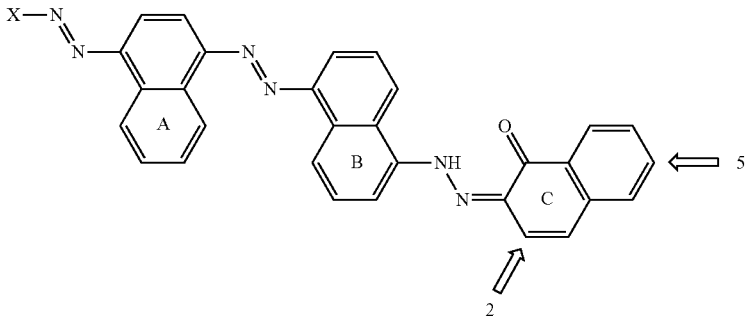

where at least two of the A, B and C naphthyl rings are substituted by a sulfonate group, the C ring may be substituted at the 5 position by an $NH_2$ or NHPh group, X is a benzyl or naphthyl ring substituted with up to 2 sulfonate groups and may be substituted at the 2 position with an OH group and may also be substituted with an $NH_2$ or NHPh group.

(2) Bis-Azo Direct Violet Dyes of the Formula:

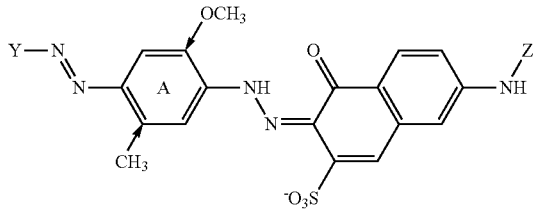

where Z is H or phenyl, the A ring is typically substituted by a methyl and methoxy group at the positions indicated by arrows, the A ring may also be a naphthyl ring, the Y group is a phenyl or naphthyl ring, which may be substituted with one or more sulphonate group(s) and may be mono or disubstituted by methyl groups.

(3) Blue or Red Acid Dyes of the Formula

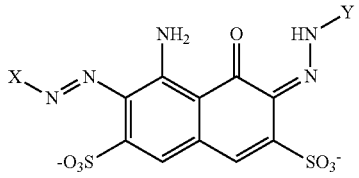

where at least one of X and Y must be an aromatic group. In one aspect, both the aromatic groups may be a substituted phenyl or naphthyl group, which may be substituted with non water-solubilising groups such as alkyl or alkyloxy or aryloxy groups, X and Y may not be substituted with water solubilising groups such as sulfonates or carboxylates. In another aspect, X is a nitro substituted phenyl group and Y is a phenyl group (4) Red Acid Dyes of the Structure

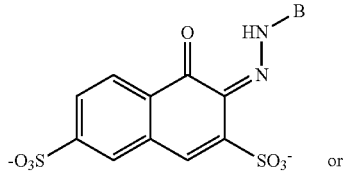

or

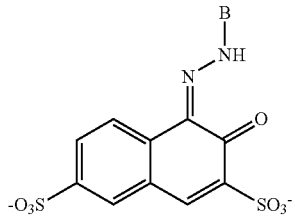

where B is a naphthyl or phenyl group that may be substituted with non water solubilising groups such as alkyl or alkyloxy or aryloxy groups, B may not be substituted with water solubilising groups such as sulfonates or carboxylates.

(5) Dis-Azo Dyes of the Structure

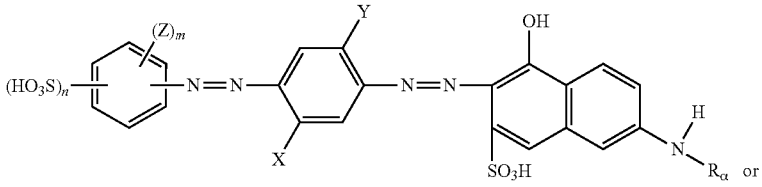

or

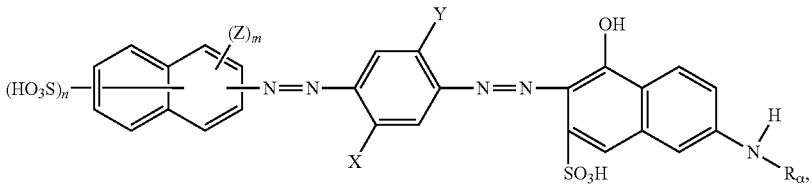

wherein X and Y, independently of one another, are each hydrogen, $C_1$-$C_4$ alkyl or $C_1$-$C_4$-alkoxy, Rα is hydrogen or aryl, Z is $C_1$-$C_4$ alkyl; $C_1$-$C_4$-alkoxy; halogen; hydroxyl or carboxyl, n is 1 or 2 and m is 0, 1 or 2, as well as corresponding salts thereof and mixtures thereof
(6) Triphenylmethane Dyes of the Following Structures
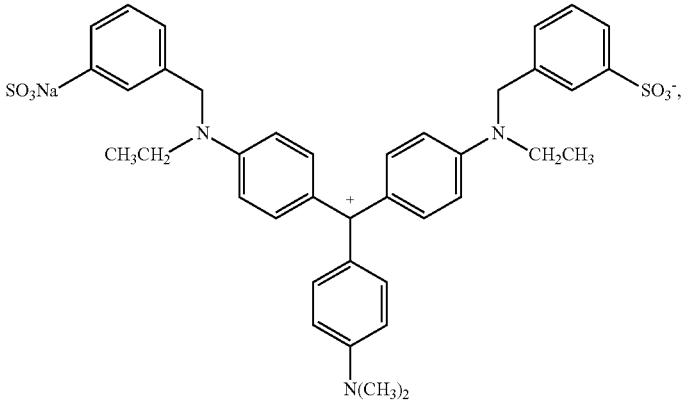
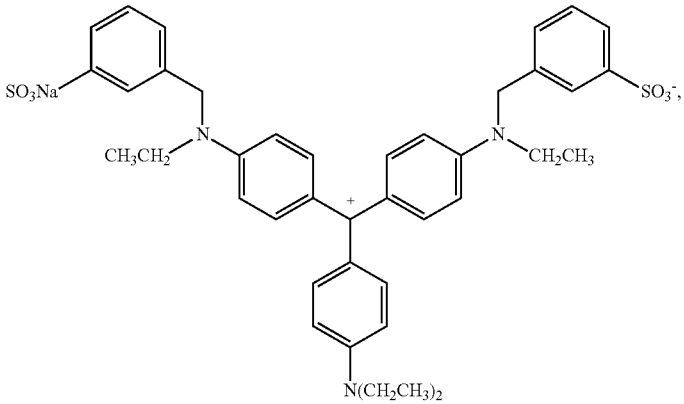
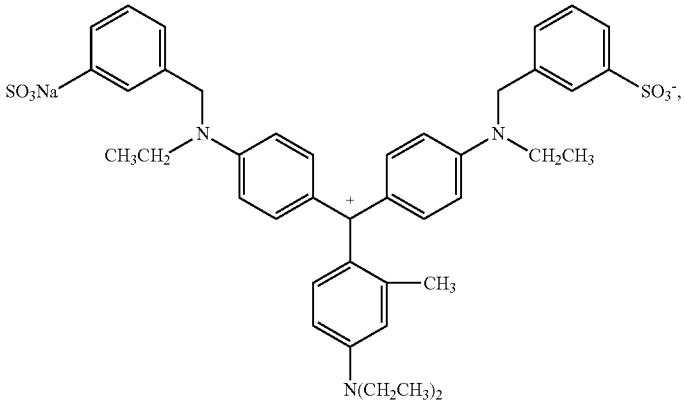

-continued

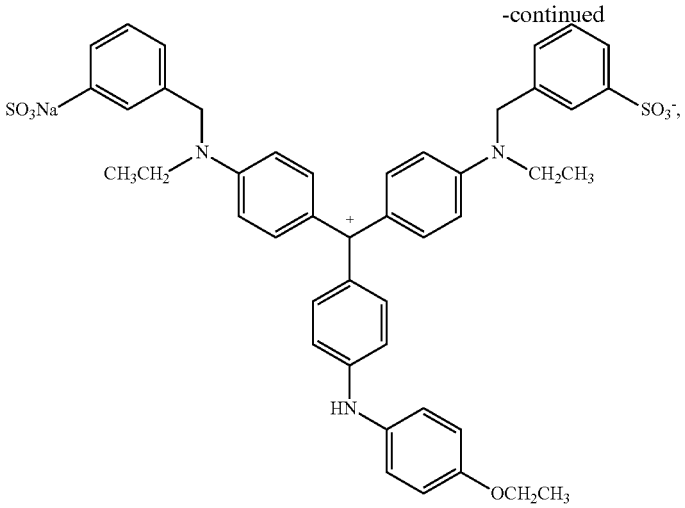

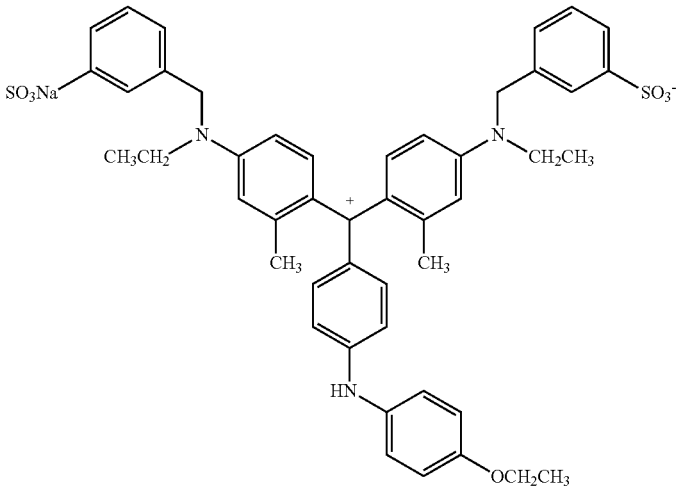

and/or

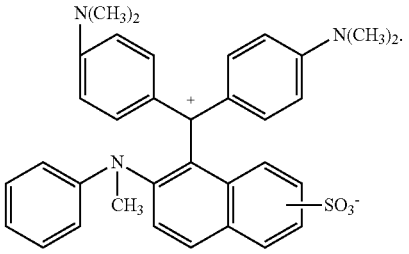

and mixtures thereof.

The hueing dye may be a small molecule dye selected from the group consisting of Colour Index (Society of Dyers and Colourists, Bradford, UK) numbers Direct Violet 9, Direct Violet 35, Direct Violet 48, Direct Violet 51, Direct Violet 66, Direct Violet 99, Direct Blue 1, Direct Blue 71, Direct Blue 80, Direct Blue 279, Acid Red 17, Acid Red 73, Acid Red 88, Acid Red 150, Acid Violet 15, Acid Violet 17, Acid Violet 24, Acid Violet 43, Acid Red 52, Acid Violet 49, Acid Blue 15, Acid Blue 17, Acid Blue 25, Acid Blue 29, Acid Blue 40, Acid Blue 45, Acid Blue 75, Acid Blue 80, Acid Blue 83, Acid Blue 90 and Acid Blue 113, Acid Black 1, Basic Violet 1, Basic Violet 3, Basic Violet 4, Basic Violet 10, Basic Violet 35, Basic Blue 3, Basic Blue 16, Basic Blue 22, Basic Blue 47, Basic Blue 66, Basic Blue 75, Basic Blue 159 and mixtures thereof. Particularly preferred in this group is Direct Violet 99.

Suitable small molecule dyes may include small molecule dyes selected from 1,4-Naphthalenedione, 1-[2-[2-[4-[[4-(acetyloxy)butyl]ethylamino]-2-methylphenyl]diazenyl]-5-nitro-3-thienyl]-Ethanone, 1-hydroxy-2-(1-naphthalenylazo)-Naphthalenedisulfonic acid, ion(2−), 1-hydroxy-2-[[4-(phenylazo)phenyl]azo]-Naphthalenedisulfonic acid, ion (2−), 2-[(1E)-[4-[bis(3-methoxy-3-oxopropyl)amino]-2-methylphenyl]azo]-5-nitro-3-Thiophenecarboxylic acid, ethyl ester, 2-[[4-[(2-cyanoethyl)ethylamino]phenyl]azo]-5-(phenylazo)-3-Thiophenecarbonitrile, 2-[2-[4-[(2-cyanoethyl)ethylamino]phenyl]diazenyl]-5-[2-(4-nitrophenyl)diazenyl]-3-Thiophenecarbonitrile, 2-hydroxy-1-(1-naphthalenylazo)-Naphthalenedisulfonic acid, ion(2−), 2-hydroxy-[[4-(phenylazo)phenyl]azo]-Naphthalenedisulfonic acid, ion(2−), 4,4'-[[4-(dimethylamino)-2,5-cyclohexadien-1-ylidene]methylene]bis[N,N-dimethyl-Benzenamine, 6-hydroxy-5-[(4-methoxyphenyl)azo]-2-Naphthalenesulfonic acid, monosodium salt, 6-hydroxy-5-[(4-methylphenyl)azo]-2-Naphthalenesulfonic acid, monosodium salt, 7-hydroxy-8-[[4-(phenylazo)phenyl]azo]-1,3-Naphthalenedisulfonic acid, ion(2−), 7-hydroxy-8-[2-(1-naphthalenyl)diazenyl]-1,3-Naphthalenedisulfonic acid, ion(2−), 8-hydroxy-7-[2-(1-naphthalenyl)diazenyl]-1,3-Naphthalenedisulfonic acid, ion(2−), 8-hydroxy-7-[2-[4-(2-phenyldiazenyl)phenyl]diazenyl]-1,3-Naphthalenedisulfonic acid, ion(2−), Acid Black 1, Acid black 24, Acid Blue 113, Acid Blue 25, Acid blue 29, Acid blue 3, Acid blue 40, Acid blue 45, Acid blue 62, Acid blue 7, Acid Blue 80, Acid blue 9, Acid green 27, Acid orange 12, Acid orange 7, Acid red 14, Acid red 151, Acid red 17, Acid red 18, Acid red 266, Acid red 27, Acid red 4, Acid red 51, Acid red 73, Acid red 87, Acid red 88, Acid red 92, Acid red 94, Acid red 97, Acid Violet 17, Acid violet 43, Basic blue 9, Basic violet 2, C.I. Acid black 1, C.I. Acid Blue 10, C.I. Acid Blue 290, C.I. Acid Red 103, C.I. Acid red 91, C.I. Direct Blue 120, C.I. Direct Blue 34, C.I. Direct Blue 70, C.I. Direct Blue 72, C.I. Direct Blue 82, C.I. Disperse Blue 10, C.I. Disperse Blue 100, C.I. Disperse Blue 101, C.I. Disperse Blue 102, C.I. Disperse Blue 106:1, C.I. Disperse Blue 11, C.I. Disperse Blue 12, C.I. Disperse Blue 121, C.I. Disperse Blue 122, C.I. Disperse Blue 124, C.I. Disperse Blue 125, C.I. Disperse Blue 128, C.I. Disperse Blue 130, C.I. Disperse Blue 133, C.I. Disperse Blue 137, C.I. Disperse Blue 138, C.I. Disperse Blue 139, C.I. Disperse Blue 142, C.I. Disperse Blue 146, C.I. Disperse Blue 148, C.I. Disperse Blue 149, C.I. Disperse Blue 165, I. Disperse Blue 165:1, C.I. Disperse Blue 165:2, C.I. Disperse Blue 165:3, C.I. Disperse Blue 171, C.I. Disperse Blue 173, C.I. Disperse Blue 174, C.I. Disperse Blue 175, C.I. Disperse Blue 177, C.I. Disperse Blue 183, C.I. Disperse Blue 187, C.I. Disperse Blue 189, C.I. Disperse Blue 193, C.I. Disperse Blue 194, C.I. Disperse Blue 200, C.I. Disperse Blue 201, C.I. Disperse Blue 202, C.I. Disperse Blue 205, C.I. Disperse Blue 206, C.I. Disperse Blue 207, C.I. Disperse Blue 209, C.I. Disperse Blue 21, C.I. Disperse Blue 210, C.I. Disperse Blue 211, C.I. Disperse Blue 212, C.I. Disperse Blue 219, C.I. Disperse Blue 220, C.I. Disperse Blue 222, C.I. Disperse Blue 224, C.I. Disperse Blue 225, C.I. Disperse Blue 248, C.I. Disperse Blue 252, C.I. Disperse Blue 253, C.I. Disperse Blue 254, C.I. Disperse Blue 255, C.I. Disperse Blue 256, C.I. Disperse Blue 257, C.I. Disperse Blue 258, C.I. Disperse Blue 259, C.I. Disperse Blue 260, C.I. Disperse Blue 264, C.I. Disperse Blue 265, C.I. Disperse Blue 266, C.I. Disperse Blue 267, C.I. Disperse Blue 268, C.I. Disperse Blue 269, C.I. Disperse Blue 270, C.I. Disperse Blue 278, C.I. Disperse Blue 279, C.I. Disperse Blue 281, C.I. Disperse Blue 283, C.I. Disperse Blue 284, C.I. Disperse Blue 285, C.I. Disperse Blue 286, C.I. Disperse Blue 287, C.I. Disperse Blue 290, C.I. Disperse Blue 291, C.I. Disperse Blue 294, C.I. Disperse Blue 295, C.I. Disperse Blue 30, C.I. Disperse Blue 301, C.I. Disperse Blue 303, C.I. Disperse Blue 304, C.I. Disperse Blue 305, C.I. Disperse Blue 313, C.I. Disperse Blue 315, C.I. Disperse Blue 316, C.I. Disperse Blue 317, C.I. Disperse Blue 321, C.I. Disperse Blue 322, C.I. Disperse Blue 324, C.I. Disperse Blue 328, C.I. Disperse Blue 33, C.I. Disperse Blue 330, C.I. Disperse Blue 333, C.I. Disperse Blue 335, C.I. Disperse Blue 336, C.I. Disperse Blue 337, C.I. Disperse Blue 338, C.I. Disperse Blue 339, C.I. Disperse Blue 340, C.I. Disperse Blue 341, C.I. Disperse Blue 342, C.I. Disperse Blue 343, C.I. Disperse Blue 344, C.I. Disperse Blue 345, C.I. Disperse Blue 346, C.I. Disperse Blue 351, C.I. Disperse Blue 352, C.I. Disperse Blue 353, C.I. Disperse Blue 355, C.I. Disperse Blue 356, C.I. Disperse Blue 357, C.I. Disperse Blue 358, C.I. Disperse Blue 36, C.I. Disperse Blue 360, C.I. Disperse Blue 366, C.I. Disperse Blue 368, C.I. Disperse Blue 369, C.I. Disperse Blue 371, C.I. Disperse Blue 373, C.I. Disperse Blue 374, C.I. Disperse Blue 375, C.I. Disperse Blue 376, C.I. Disperse Blue 378, C.I. Disperse Blue 38, C.I. Disperse Blue 42, C.I. Disperse Blue 43, C.I. Disperse Blue 44, C.I. Disperse Blue 47, C.I. Disperse Blue 79, C.I. Disperse Blue 79:1, C.I. Disperse Blue 79:2, C.I. Disperse Blue 79:3, C.I. Disperse Blue 82, C.I. Disperse Blue 85, C.I. Disperse Blue 88, C.I. Disperse Blue 90, C.I. Disperse Blue 94, C.I. Disperse Blue 96, C.I. Disperse Violet 10, C.I. Disperse Violet 100, C.I. Disperse Violet 102, C.I. Disperse Violet 103, C.I. Disperse Violet 104, C.I. Disperse Violet 106, C.I. Disperse Violet 107, C.I. Disperse Violet 12, C.I. Disperse Violet 13, C.I. Disperse Violet 16, C.I. Disperse Violet 2, C.I. Disperse Violet 24, C.I. Disperse Violet 25, C.I. Disperse Violet 3, C.I. Disperse Violet 33, C.I. Disperse Violet 39, C.I. Disperse Violet 42, C.I. Disperse Violet 43, C.I. Disperse Violet 45, C.I. Disperse Violet 48, C.I. Disperse Violet 49, C.I. Disperse Violet 5, C.I. Disperse Violet 50, C.I. Disperse Violet 53, C.I. Disperse Violet 54, C.I. Disperse Violet 55, C.I. Disperse Violet 58, C.I. Disperse Violet 6, C.I. Disperse Violet 60, C.I. Disperse Violet 63, C.I. Disperse Violet 66, C.I. Disperse Violet 69, C.I. Disperse Violet 7, C.I. Disperse Violet 75, C.I. Disperse Violet 76, C.I. Disperse Violet 77, C.I. Disperse Violet 82, C.I. Disperse Violet 86, C.I. Disperse Violet 88, C.I. Disperse Violet 9, C.I. Disperse Violet 91, C.I. Disperse Violet 92, C.I. Disperse Violet 93, C.I. Disperse Violet 93:1, C.I. Disperse Violet 94, C.I. Disperse Violet 95, C.I. Disperse Violet 96, C.I. Disperse Violet 97, C.I. Disperse Violet 98, C.I. Disperse Violet 99, C.I. Reactive Black 5, C.I. Reactive Blue 19, C.I. Reactive Blue 4, C.I. Reactive Red 2, C.I. Solvent Blue 43, C.I. Solvent Blue 43, C.I. Solvent Red 14, C.I. Acid black 24, C.I. Acid blue 113, C.I. Acid Blue 29, C.I. Direct violet 7, C.I. Food Red 14, Dianix Violet CC, Direct Blue 71, Direct blue 75, Direct blue 78, Direct violet 11, Direct violet 31, Direct violet 5, Direct Violet 51, Direct violet 9, Disperse Blue 106, Disperse blue 148, Disperse blue 165, Disperse Blue 3, Disperse Blue 354, Disperse Blue 364, Disperse blue 367, Disperse Blue 56, Disperse Blue 77, Disperse Blue 79, Disperse blue 79:1, Disperse Red 1, Disperse Red 15, Disperse Violet 26, Disperse Violet 27, Disperse Violet 28, Disperse violet 63, Disperse violet 77, Eosin Y, Ethanol 2,2'-[[4-[(3,5-dinitro-2-thienyl)azo]phenyl]imino]bis-, diacetate (ester), Lumogen F Blue 650, Lumogen F Violet 570, N-[2-[2-(3-acetyl-5-nitro-2-thienyl)diazenyl]-5-(diethylamino)phenyl]-Acetamide, N-[2-[2-(4-chloro-3-cyano-5-formyl-2-thienyl)diazenyl]-5-(diethylamino)phenyl]-Acetamide, N-[5-[bis(2-methoxyethyl)amino]-2-[2-(5-nitro-2,1-benzisothiazol-3-yl)diazenyl]phenyl]-Acetamide, N-[5-[bis[2-(acetyloxy)ethyl]amino]-2-[(2-bromo-4,6-dinitrophenyl)azo]phenyl]-Acetamide, Naphthalimide and derivatives thereof, Oil Black 860, Phloxine B, Pyrazole, Rose Bengal, Sodium 6-hydroxy-5-(4-isopropylphenylazo)-2-naphthalenesulfonate, Solvent Black 3, Solvent Blue 14, Solvent Blue 35, Solvent Blue 58, Solvent Blue 59, Solvent Red 24, Solvent Violet 13, Solvent Violet 8, Sudan Red 380, Triphenylmethane, Triphenylmethane and derivatives thereof, or mixtures thereof.

Suitable polymeric dyes include polymeric dyes selected from the group consisting of polymers containing conjugated chromogens (dye-polymer conjugates) and polymers with chromogens co-polymerized into the backbone of the polymer and mixtures thereof.

Other suitable polymeric dyes include polymeric dyes selected from the group consisting of fabric-substantive hueing dyes of formula I above available from Milliken (Spartanburg, S.C., USA), dye-polymer conjugates formed from at least one reactive dye and a polymer selected from the group consisting of polymers comprising a moiety selected from the group consisting of a hydroxyl moiety, a primary amine moiety, a secondary amine moiety, a thiol moiety and mixtures thereof. In still another aspect, suitable polymeric dyes include polymeric dyes selected from the group consisting of carboxymethyl cellulose (CMC) conjugated with a reactive blue, reactive violet or reactive red dye such as CMC conjugated with C.I. Reactive Blue 19, sold by Megazyme, Wicklow, Ireland under the product name AZO-CM-CELLULOSE, product code S-ACMC, alkoxylated triphenylmethane polymeric colourants, alkoxylated thiophene polymeric colourants, alkoxylated thiazolium polymeric colourants, and mixtures thereof.

The hueing dye may be part of a dye clay conjugate. Suitable dye clay conjugates include dye clay conjugates selected from the group comprising at least one cationic/basic dye and a smectite clay, and mixtures thereof. In another aspect, suitable dye clay conjugates include dye clay conjugates selected from the group consisting of one cationic/basic dye selected from the group consisting of C.I. Basic Yellow 1 through 108, C.I. Basic Orange 1 through 69, C.I. Basic Red 1 through 118, C.I. Basic Violet 1 through 51, C.I. Basic Blue 1 through 164, C.I. Basic Green 1 through 14, C.I. Basic Brown 1 through 23, CI Basic Black 1 through 11, and a clay selected from the group consisting of Montmorillonite clay, Hectorite clay, Saponite clay and mixtures thereof. In still another aspect, suitable dye clay conjugates include dye clay conjugates selected from the group consisting of: Montmorillonite Basic Blue B7 C.I. 42595 conjugate, Montmorillonite Basic Blue B9 C.I. 52015 conjugate, Montmorillonite Basic Violet V3 C.I. 42555 conjugate, Montmorillonite Basic Green G1 C.I. 42040 conjugate, Montmorillonite Basic Red R1 C.I. 45160 conjugate, Montmorillonite C.I. Basic Black 2 conjugate, Hectorite Basic Blue B7 C.I. 42595 conjugate, Hectorite Basic Blue B9 C.I. 52015 conjugate, Hectorite Basic Violet V3 C.I. 42555 conjugate, Hectorite Basic Green G1 C.I. 42040 conjugate, Hectorite Basic Red R1 C.I. 45160 conjugate, Hectorite C.I. Basic Black 2 conjugate, Saponite Basic Blue B7 C.I. 42595 conjugate, Saponite Basic Blue B9 C.I. 52015 conjugate, Saponite Basic Violet V3 C.I. 42555 conjugate, Saponite Basic Green G1 C.I. 42040 conjugate, Saponite Basic Red R1 C.I. 45160 conjugate, Saponite C.I. Basic Black 2 conjugate and mixtures thereof.

Other suitable hueing dyes can be found in patents WO 05/3275, WO 06/4870, WO 06/4876, WO 06/21285, WO 06/27086, WO 06/102984, WO07/93303, WO 09/87032, WO 09/87034 and US 2009/118155

Preferably, the hueing dye is present in the wash liquor in a level greater than 80 ppb, preferably from about 1 to 1000 ppb, more preferably from about 20 to about 300 ppb and especially from about 40 to about 200 ppb.

Brightener

Any optical brighteners or other brightening agents known in the art are suitable for use herein. Commercial optical brighteners which may be useful in the present invention can be classified into subgroups, which include derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982). Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM; available from Ciba-Geigy; Artic White CC and Artic White CWD, available from Hilton-Davis, located in Italy; the 2-(4-styryl-phenyl)-2H-napthol[1,2-d]triazoles; 4,4'-bis-(1,2,3-triazol-2-yl)-stil-benes; 4,4'-bis(styryl)bisphenyls; and the aminocoumarins. Specific examples of these brighteners include 4-methyl-7-diethyl-amino coumarin; 1,2-bis(venzimidazol-2-yl)ethylene; 1,3-diphenyl-phrazolines; 2,5-bis(benzoxazol-2-yl)thiophene; 2-styryl-napth-[1,2-d]oxazole; and 2-(stilbene-4-yl)-2H-naphtho-[1,2-d]triazole. See also U.S. Pat. No. 3,646,015, issued Feb. 29, 1972 to Hamilton. Anionic brighteners are preferred herein. Preferred brightener is Tinopal CBS (Disodium 4,4' bis(2-sulfostyryl))biphenyl.

Preferably, the brightener is present in the wash liquor in a level of from about 0.1 to about 100 ppm, more preferably from about 1 to about 30 ppm and especially from about 2 to about 10 ppm. Preferably the level of brightener in the whitening additive is from 0.03% to 5%, more preferably from 0.1% to 2% and especially from 0.2% to 1% by weight of the whitening additive.

Detergent Composition

The detergent composition for use herein preferably has a neutral pH, i.e. from about 5 to about 9, more preferably from about 6 to about 8 (as measured at 1% wt solution in distilled water at 20° C.). Compositions having this pH range have been found to be less aggressive on fabrics than acidic or alkaline solutions. Preferably, the detergent is a liquid detergent.

Detersive Surfactant

Compositions suitable for use herein comprises from 5% to 70% by weight, preferably from 10% to 60% by weight, more preferably from 20% to 50% by weight, of a certain kind of detersive surfactant component. Such an essential detersive surfactant component must comprise anionic surfactants, nonionic surfactants, or combinations of these two surfactant types.

Suitable anionic surfactants useful herein can comprise any of the conventional anionic surfactant types typically used in liquid detergent products. These include the alkyl benzene sulfonic acids and their salts as well as alkoxylated or un-alkoxylated alkyl sulfate materials.

Preferred anionic surfactants are the alkali metal salts of $C_{10-16}$ alkyl benzene sulfonic acids, preferably $C_{11-14}$ alkyl benzene sulfonic acids. Preferably the alkyl group is linear and such linear alkyl benzene sulfonates are known as "LAS". Alkyl benzene sulfonates, and particularly LAS, are well known in the art. Such surfactants and their preparation are described for example in U.S. Pat. Nos. 2,220,099 and 2,477,383. Especially preferred are the sodium and potassium linear straight chain alkylbenzene sulfonates in which the average number of carbon atoms in the alkyl group is from about 11 to 14. Sodium $C_{11}$-$C_{14}$, e.g., $C_{12}$, LAS is especially preferred. Preferably the anionic surfactant comprises at least 50%, more preferably at least 60% and especially 70% by weight of the anionic surfactant of LAS.

Another preferred type of anionic surfactant comprises ethoxylated alkyl sulfate surfactants. Such materials, also known as alkyl ether sulfates or alkyl polyethoxylate sulfates, are those which correspond to the formula:

$$R'—O—(C_2H_4O)_n—SO_3M$$

wherein R' is a $C_8$-$C_{20}$ alkyl group, n is from about 1 to 20, and M is a salt-forming cation. Preferably, R' is $C_{10}$-$C_{18}$ alkyl, n is from about 1 to 15, and M is sodium, potassium, ammonium, alkylammonium, or alkanolammonium. Most preferably, R' is a $C_{12}$-$C_{16}$, n is from about 1 to 6 and M is sodium.

The alkyl ether sulfates will generally be used in the form of mixtures comprising varying R' chain lengths and varying degrees of ethoxylation. Frequently such mixtures will inevitably also contain some unethoxylated alkyl sulfate materials, i.e., surfactants of the above ethoxylated alkyl sulfate formula wherein n=0. Unethoxylated alkyl sulfates may also be added separately to the compositions of this invention and used as or in any anionic surfactant component which may be present.

Preferred unalkoxyxylated, e.g., unethoxylated, alkyl ether sulfate surfactants are those produced by the sulfation of higher $C_8$-$C_{20}$ fatty alcohols. Conventional primary alkyl sulfate surfactants have the general formula:

$$ROSO_3\text{-}M^+$$

wherein R is typically a linear $C_8$-$C_{20}$ hydrocarbyl group, which may be straight chain or branched chain, and M is a water-solubilizing cation. Preferably R is a $C_{10}$-$C_{15}$ alkyl, and M is alkali metal. Most preferably R is $C_{12}$-$C_{14}$ and M is sodium.

Suitable nonionic surfactants useful herein can comprise any of the conventional nonionic surfactant types typically used in liquid detergent products. These include alkoxylated fatty alcohols, ethylene oxide (EO)-propylene oxide (PO) block polymers, and amine oxide surfactants. Preferred for use in the liquid detergent products herein are those nonionic surfactants which are normally liquid.

Preferred nonionic surfactants for use herein include the alcohol alkoxylate nonionic surfactants. Alcohol alkoxylates are materials which correspond to the general formula:

$$R^1(C_mH_{2m}O)_nOH$$

wherein $R^1$ is a $C_8$-$C_{16}$ alkyl group, m is from 2 to 4, and n ranges from about 2 to 12. Preferably $R^1$ is an alkyl group, which may be primary or secondary, that contains from about 9 to 15 carbon atoms, more preferably from about 10 to 14 carbon atoms. Preferably also the alkoxylated fatty alcohols will be ethoxylated materials that contain from about 2 to 12 ethylene oxide moieties per molecule, more preferably from about 3 to 10 ethylene oxide moieties per molecule.

The alkoxylated fatty alcohol materials useful in the liquid detergent compositions herein will frequently have a hydrophilic-lipophilic balance (HLB) which ranges from about 3 to 17. More preferably, the HLB of this material will range from about 6 to 15, most preferably from about 8 to 15. Alkoxylated fatty alcohol nonionic surfactants have been marketed under the tradenames Neodol and Dobanol by the Shell Chemical Company.

Another type of nonionic surfactant which is liquid and which may be utilized in the compositions of this invention comprises the ethylene oxide (EO)-propylene oxide (PO) block polymers. Materials of this type are well known nonionic surfactants which have been marketed under the tradename Pluronic. These materials are formed by adding blocks of ethylene oxide moieties to the ends of polypropylene glycol chains to adjust the surface active properties of the resulting block polymers. EO-PO block polymer nonionics of this type are described in greater detail in Davidsohn and Milwidsky; Synthetic Detergents, 7th Ed.; Longman Scientific and Technical (1987) at pp. 34-36 and pp. 189-191 and in U.S. Pat. Nos. 2,674,619 and 2,677,700.

Yet another suitable type of nonionic surfactant useful herein comprises the amine oxide surfactants. Amine oxides are materials which are often referred to in the art as "semi-polar" nonionics. Amine oxides have the formula: $R(EO)_x(PO)_y(BO)_zN(O)(CH_2R')_2.qH_2O$. In this formula, R is a relatively long-chain hydrocarbyl moiety which can be saturated or unsaturated, linear or branched, and can contain from 8 to 20, preferably from 10 to 16 carbon atoms, and is more preferably $C_{12}$-$C_{16}$ primary alkyl. R' is a short-chain moiety preferably selected from hydrogen, methyl and —$CH_2OH$. When x+y+z is different from 0, EO is ethyleneoxy, PO is propyleneneoxy and BO is butyleneoxy. Amine oxide surfactants are illustrated by $C_{12-14}$ alkyldimethyl amine oxide.

In the liquid detergent compositions herein, the essential detersive surfactant component may comprise combinations of anionic and nonionic surfactant materials. When this is the case, the weight ratio of anionic to nonionic will typically range from 100:1 to 1:100, more typically from 20:1 to 1:20.

Laundry Washing Adjuncts

The detergent compositions herein, preferably in liquid form, comprise from 0.1% to 30% by weight, preferably from 0.5% to 20% by weight, more preferably from 1% to 10% by weight, of one or more of certain kinds of laundry washing adjuncts. Such laundry washing adjuncts can be selected from detersive enzymes, builders, chelants, soil release polymers, soil suspending polymers, dye transfer inhibition agents, bleach, suds suppressors, fabric care benefit agents, solvents, stabilizers, buffers, structurants and perfumes and combinations of these adjunct types. All of these materials are of the type conventionally utilized in laundry detergent products.

Detersive Enzymes

Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, mannanases, pentosanases, malanases, β-glucanases, arabinosidases, hyaluronidase, chondroitinase, laccase, and known amylases, or combinations thereof. A preferred enzyme combination comprises a cocktail of conventional detersive enzymes like protease, lipase, cutinase and/or cellulase in conjunction with amylase. Detersive enzymes are described in greater detail in U.S. Pat. No. 6,579,839.

If employed, enzymes will normally be incorporated into the base detergent compositions herein at levels sufficient to provide up to 10 mg by weight, more typically from about 0.01 mg to about 5 mg, of active enzyme per gram of the composition. Stated otherwise, the aqueous liquid detergent compositions herein can typically comprise from 0.001% to 5%, preferably from 0.01% to 1% by weight, of a commercial enzyme preparation. Protease enzymes, for example, are usually present in such commercial preparations at levels sufficient to provide from 0.005 to 0.1 Anson units (AU) of activity per gram of detergent composition.

The detergent may also include from about 0.05 to about 0.5% of preservatives non-limiting examples of which include didecyl dimethyl ammonium chloride which is available under the tradename UNIQUAT (from Lonza of Basel Switzerland), 1,2-benzisothiozolin-3-one, which is available under the tradename PROPEL (from Arch Chemicals of Norwalk, Conn.), dimethylol-5,5-dimethylhydantoin which is available under the tradename DANTOGUARD (from Lonza of Basel Switzerland), 5-Chloro-2-methyl-4-isothiazolin-3-one/2-methyl-4-isothiazolin-3-one, which is available under the tradename KATHON (from Rohm and Haas of Philadelphia, Pa.), and mixtures thereof.

Other Fabric Care Benefit Agents

The detergent composition for use herein may also comprise additional fabric care or benefit agents which can be deposited onto fabrics being laundered and which thereupon provide one or more types of fabric care or treatment benefits. Such benefits can include, for example, fabric softness, anti-static effects, ease-of-ironing benefits, anti-abrasion benefits, anti-pilling effects, color protection, wrinkle removal or improved resistance to wrinkling, fabric substantive perfume or odor benefits, malodor protection benefits, and the like.

A wide variety of materials which are suitable for providing such benefits and which can be deposited onto fabrics being laundered are known in the art. Such materials can include, for example, clays; starches; polyamines; un-functionalized and functionalized silicones such as aminosilicones and quaternary nitrogen-containing cationic silicones; cellulosic polymers, and the like. Materials of these types are described in greater detail in one or more of the following publications: U.S. Pat. No. 6,525,013; U.S. Pat. No. 4,178,254; WO 02/40627; WO 02/18528; WO 00/71897; WO 00/71806; WO 98/39401; and WO 98/29528.

If employed, such additional fabric care benefit agents polymers can typically be incorporated into the liquid laundry detergent compositions herein in concentrations ranging from 0.05% to 20%, by weight, depending upon the nature of the materials to be deposited and the benefit(s) they are to provide. More preferably, such fabric care benefit agents can comprise from 0.1% to 10%, by weight of the composition.

Fabric Enhancer

The fabric enhancer for use herein comprises a fabric softening active. Suitable fabric softening actives, include, but are not limited to, materials selected from the group consisting of quats, amines, fatty esters, sucrose esters, silicones, dispersible polyolefins, clays, polysaccharides, fatty oils, polymer latexes and mixtures thereof. Preferably the fabric softening active is a quaternary ammonium compound.

Typical minimum levels of incorporation of the fabric softening active in the present fabric enhancer is at least about 1%, alternatively at least about 2%, alternatively at least about at least about 3%, alternatively at least about at least about 5%, alternatively at least about 10%, and alternatively at least about 12%, by weight of the fabric enhancer. The fabric enhancer may typically comprise maximum levels of fabric softening active of about less than about 90%, alternatively less than about 40%, alternatively less than about 30%, alternatively less than about 20%, by weight of the fabric enhancer.

Fabric enhancers suitable for use herein comprise perfume microcapsules, preferably the fabric enhancer also comprises additional perfume to that found in the microcapsules. The microcapsules comprise a core material and a wall material that at least partially surrounds, but preferably completely surrounds, the core material.

Useful wall materials include materials selected from the group consisting of polyethylenes, polyamides, polystyrenes, polyisoprenes, polycarbonates, polyesters, polyacrylates, polyureas, polyurethanes, polyolefins, polysaccharides, epoxy resins, vinyl polymers, and mixtures thereof.

In one aspect, useful wall materials include materials that are sufficiently impervious to the core material and the materials in the environment in which the benefit agent containing delivery particle will be employed, to permit the delivery benefit to be obtained. Suitable impervious wall materials include materials selected from the group consisting of reaction products of one or more amines with one or more aldehydes, such as urea cross-linked with formaldehyde or gluteraldehyde, melamine cross-linked with formaldehyde; gelatin-polyphosphate coacervates optionally cross-linked with gluteraldehyde; gelatin-gum Arabic coacervates; cross-linked silicone fluids; polyamine reacted with polyisocyanates and mixtures thereof. In one aspect, the wall material comprises melamine cross-linked with formaldehyde.

The core material comprises a perfume. In one aspect, said perfume comprises perfume raw materials selected from the group consisting of alcohols, ketones, aldehydes, esters, ethers, nitriles alkenes and mixtures thereof. In one aspect, said perfume may comprise a perfume raw material selected from the group consisting of perfume raw materials having a boiling point (B.P.) lower than about 250° C. and a C log P lower than about 3, perfume raw materials having a B.P. of greater than about 250° C. and a C log P of greater than about 3, perfume raw materials having a B.P. of greater than about 250° C. and a C log P lower than about 3, perfume raw materials having a B.P. lower than about 250° C. and a C log P greater than about 3 and mixtures thereof. Perfume raw materials having a boiling point B.P. lower than about 250° C. and a C log P lower than about 3 are known as Quadrant I perfume raw materials, perfume raw materials having a B.P. of greater than about 250° C. and a C log P of greater than about 3 are known as Quadrant IV perfume raw materials, perfume raw materials having a B.P. of greater than about 250° C. and a C log P lower than about 3 are known as Quadrant II perfume raw materials, perfume raw materials having a B.P. lower than about 250° C. and a C log P greater than about 3 are known as a Quadrant III perfume raw materials. In one aspect, said perfume comprises a perfume raw material having B.P. of lower than about 250° C. In one aspect, said perfume comprises a perfume raw material selected from the group consisting of Quadrant I, II, III perfume raw materials and mixtures thereof. In one aspect, said perfume comprises a Quadrant III perfume raw material. Suitable Quadrant I, II, III and IV perfume raw materials are disclosed in U.S. Pat. No. 6,869,923 B1.

In one aspect, said perfume comprises a Quadrant IV perfume raw material. While not being bound by theory, it is believed that such Quadrant IV perfume raw materials can improve perfume odor "balance". Said perfume may comprise, based on total perfume weight, less than about 30%, less than about 20%, or even less than about 15% of said Quadrant IV perfume raw material.

The perfume raw materials and accords may be obtained from one or more of the following companies Firmenich (Geneva, Switzerland), Givaudan (Argenteuil, France), IFF (Hazlet, N.J.), Quest (Mount Olive, N.J.), Bedoukian (Danbury, Conn.), Sigma Aldrich (St. Louis, Mo.), Millennium Specialty Chemicals (Olympia Fields, Ill.), Polarone International (Jersey City, N.J.), Fragrance Resources (Keyport, N.J.), and Aroma & Flavor Specialties (Danbury, Conn.).

The fabric enhancer preferably comprises from about 0.01 to about 10, from about 0.1 to about 8, or even from about 0.2 to about 5 weight % of said particle based on total composition weight.

The microcapsules disclosed in the present application may be made via the teachings of U.S. Pat. No. 6,592,990 B2 and/or U.S. Pat. No. 6,544,926 B1 and the examples disclosed herein.

EXAMPLES

Example 1

The washing test was carried out using Electrolux W465H industrial washing machines. The wash cycle included a 35° C. first washing step, a 60° C. second washing step and three subsequent cold water washing steps, all using hard water (13° dH). The fabrics were successively dried using Miele Professional 5206 tumble dryer.

The fabric load included 6 kg of clean ballast load, composed of 67% cotton and 33% polycotton. For the reading of whiteness, 24 clean tracers of three fabric types (terry cotton, muslin cotton and polycotton) were added. The detergent was added in the first washing step, the bleach in the second washing step and the whitening additive in the third washing step.

The first washing step was carried out with the following detergent (dosed at 48 grams/machine or 8.4 ml/kg fabric).

TABLE 1

| Detergent | |
|---|---|
| Ingredient | % by weight |
| C12-alkylbenxene sulfonic acid | 12.2 |
| Non-ionic surfactant | 8.25 |
| C12-alkyl trimethyl amine N-oxide | 1.5 |
| C12-14 fatty acid | 8.3 |

TABLE 1-continued

| Detergent | |
|---|---|
| Ingredient | % by weight |
| Citric acid | 3.4 |
| Triethyleneimine penta phosphonic acid | 0.19 |
| Ethoxylated polymine polymer | 1.1 |
| Enzymes | 0.50 |
| Fabric Whitening agent | 0.2 |
| 1,2 propandiol | 4.9 |
| Ethanol | 2.8 |
| Monethanolamine | 0.83 |
| Monoethanaolamine borate | 2.4 |
| Cumene sulfonic acid | 1.9 |
| Silicone suds suppressor | 0.13 |
| Hydrogenated castor oil | 0.10 |
| Perfume and minors | 0.5 |
| Sodium hydroxide | to pH 8.0 |
| Water | Balance |

The detergent yielded wash pH's of about 8.

The second washing step was carried out by using 54 grams/machine (9 mls/kg load) of a hypochlorite bleaching product containing about 6% sodium hypochlorite, plus stabilizers and additives.

The third and fourth washing steps were carried out with cold water alone. In the fifth washing step various compositions were used, as described in table 2. They were used at a level of 16.8 mls/machine (or 2.8 mls/kg load).

TABLE 2

| Whitening additive | | | | |
|---|---|---|---|---|
| | A (control) | B % by weight | C % by weight | D % by weight |
| Sodium thiosulfate pentahydrate | — | 5.0 | 5.0 | 5.0 |
| Tinopal CBS | — | — | 0.64 | 0.64 |
| Hueing dye (compound 2) | — | — | — | 0.010 |
| Propandiol | — | — | 3.0 | 4.9 |
| C12 alkyl7-ethoxylate | — | — | 3.0 | 4.4 |
| Water and minors | | | balance | |

The laundry operation was repeated 20 times, and a fraction of the tracers were removed at cycles 5, 10, 15 and 20 for evaluation of the whiteness. The evaluation was done by visual grading by two expert graders, and their grades were averaged. Four replicates of the same stain were used, and the grades of all replicates were also averaged.

The grading was done according to the Panel Score Unit (PSU) scale, defined as follows:

0 There is no difference 1 think there is a difference

2 I am sure there is a difference

3 There is a large difference

4 There is an extremely large difference

The grades are used with a + sign if the test is better than the control, and a − sign if the test product is poorer than the control. The whiteness grades obtained by the test products are shown in Table 3.

TABLE 3

| Whiteness grading<br>PSU grades for whiteness tracers (the suffix "s" denotes that the fabric is significantly different vs the control at 95% confidence interval) | | | | |
|---|---|---|---|---|
| | | B vs A | C vs A | D vs A |
| 5 cycles | Terry | 2.0 s | 3.0 s | 3.0 s |
| | Muslin | 2.3 | 2.3 | 3.0 s |
| | Polycotton | 0.3 | 2.0 s | 2.5 s |
| | Average | 1.5 | 2.4 s | 2.8 s |
| 10 cycles | Terry | 2.0 s | 3.0 s | 3.0 s |
| | Muslin | 2.3 | 2.3 | 3.0 s |
| | Polycotton | 0.0 | 0.8 | 2.5 s |
| | Average | 1.4 | 2.0 s | 2.8 s |
| 15 cycles | Terry | 2.0 s | 3.0 s | 4.0 s |
| | Muslin | 2.0 s | 2.5 s | 3.5 s |
| | Polycotton | 0.5 | 1.5 | 3.0 s |
| | Average | 1.5 | 2.3 s | 3.5 s |
| 20 cycles | Terry | 2.0 s | 3.5 s | 4.0 s |
| | Muslin | 1.8 | 3.5 s | 3.5 s |
| | Polycotton | 1.3 | 2.0 | 2.8 |
| | Average | 1.7 | 3.0 s | 3.4 s |

The results depicted in Table 3 demonstrate that (i) the control treatment A shows a progressive whiteness deterioration with wash cycles; (ii) all the treatments B, C, D are effective at minimizing the whiteness deterioration and (iii) in nearly all cases treatment C (having thiosulfate and FWA 49) is more effective than treatment B (having thiosulfate alone), and treatment D (thiosulfate+Tinopal CBS+Violet DD) is more effective than C, thus all three ingredients contribute to deliver whiteness improvements.

The fabrics from wash above were also evaluated for odour by en expert panel. The results are in table 5 here below:

TABLE 4

| Odour grades | | | | |
|---|---|---|---|---|
| | A | B | C | D |
| Wet Fabric odour | Heavy hypochlorite odour | Nearly odour free | Nearly odour free | Nearly odour free |

Example 2

Table 5 provides another example of whitening additives according to the invention

TABLE 5

| Whitening additive | | | | | |
|---|---|---|---|---|---|
| Ingredient | % by weight | | | | |
| Sodium thiosulfate pentahydrate | 6.5 | 12.2 | 7.3 | — | 3.7 |
| Monoethanolamine | — | — | — | 4.5 | — |
| Tinopal CBS | 0.53 | — | 0.2 | 0.4 | — |
| Tinopal DMS | — | 0.8 | — | — | 0.5 |
| Hueing dye (compound 2) | 0.005 | — | — | — | — |
| Hueing dye (Direct violet 99) | — | — | — | — | 0.02 |
| Propandiol | 4.5 | 3.5 | 3.2 | 2.0 | — |
| C12-14 alkyl 7-ethoxylate | 3.5 | 2.5 | 2.0 | 2.0 | 4.5 |
| Citric acid | — | — | — | 4.5 | — |
| Minors (preservatives, suds suppressors, process aids . . .) | 0.1 | 0.1 | 0.05 | 0.2 | — |
| Water | balance | | | | |

Example 3

The table below shows some detergents which can be used as a part of the wash process of the invention.

TABLE 6

| Ingredient | Detergent A % by weight | B % by weight | C % by weight |
|---|---|---|---|
| C12-alkylbenzene sulfonic acid | 17 | 9.0 | 13 |
| C12-15 Alkyl 3-ethoxylate sulphate, MEA salt | 2.5 | 8.0 | 1.5 |
| C12-14 Alcohol 7-9 ethoxylated | 16 | 5.0 | 7.5 |
| C12-alkyl trimethyl amine N-oxide | 1.5 | — | 1.0 |
| C12-14 fatty acid | 10 | 4.0 | 6.0 |
| Citric acid | 3.0 | 3.5 | 3.0 |
| 1-Hydroxy ethylidene 1,1 diphosphonic acid | 0.5 | — | — |
| Ethoxylated, propoxylated polyamine polymers | 6.0 | 2.5 | 4.0 |
| Diethtylene triamine pentamethylene acetic acid | — | 0.4 | — |
| Protease | 1.5 | 1.2 | 0.8 |
| Mannanase | — | 0.1 | — |
| Amylase | 0.25 | 0.3 | 0.2 |
| Fabric Whitening Agent | — | 0.2 | 0.1 |
| Solvents (ethanol, glycerol, 1,2 propandiol, diethyleneglycol) | 15 | 6.0 | 8.0 |
| Sodium cumene sulfonate | — | 0.8 | 1.8 |
| Borate | — | 2.0 | 2.2 |
| Monethanolamine (MEA) | 9.0 | 4.0 | 3.0 |
| Sodium hydroxide | — | to pH 8.0 | to pH 8.0 |
| Silicone suds suppressor (BF 20+ ex Dow Corning) | 1.0 | — | 0.2 |
| Hydrogenated castor oil | 0.14 | — | 0.2 |
| Perfume, dyes, minors | 1.0 | 0.5 | 0.8 |
| Water | Balance | Balance | Balance |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference, the citation of any document is not to be construed as an admission that it is prior art with respect to the present invention. To the extent that any meaning or definition of a term in this document incorporated by reference, the meaning or definition assigned to the term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of cleaning a white load in a laundry machine, the method consisting of:

subjecting the white load to four washing steps consisting of; a first washing step with a detergent comprising a surfactant and an enzyme, wherein the first washing step is substantially free of a bleach additive; a second washing step, subsequent to the first washing step, with a bleach additive wherein the bleach additive comprises a halogen bleach; a third washing step, subsequent to the second washing step, with water alone; and a fourth washing step, subsequent to the third washing step, with a whitening additive wherein the whitening additive comprises a bleach scavenger and a hueing dye wherein the bleach scavenger is sodium thiosulfate, and wherein the whitening additive is a separate product from the detergent and the bleach additive.

2. The method of claim 1 wherein from about 50 ppm to about 1500 ppm of the bleach additive and from about 10 to about 500 ppm of bleach scavenger are delivered.

3. The method of claim 1 wherein in the fourth step, the whitening additive further comprises perfume microcapsules.

4. The method of claim 1, wherein in the fourth washing step, the whitening additive further comprises a brightener.

5. The method of claim 1, wherein in the fourth washing step, the whitening additive is substantially free of a surfactant.

6. The method of claim 1, wherein the bleach scavenger and the hueing dye are a different product than the bleach additive.

7. The method of claim 1, wherein the bleach scavenger and the hueing dye are a different product from the surfactant and the enzyme.

8. The method of claim 1, wherein the bleach additive comprises a liquid bleach.

9. The method of claim 1, wherein in the second washing step, the bleach additive is substantially free of an enzyme.

10. The method of claim 8, wherein in the fourth washing step, the whitening additive further comprises perfume microcapsules.

11. The method of claim 10, wherein the laundry machine is a professional washing machine.

* * * * *